United States Patent [19]

Roberts

[11] 4,048,903

[45] Sept. 20, 1977

[54] ROTARY HYDRAULIC MACHINE HAVING A VALVE RESPONSIVE TO ROTOR BORE PRESSURE AND STATOR PORT PRESSURE

[75] Inventor: Thomas Ernest Edwin Roberts, Birmingham, England

[73] Assignee: Lucas Industries Limited, Birmingham, England

[21] Appl. No.: 667,042

[22] Filed: Mar. 15, 1976

[30] Foreign Application Priority Data

Apr. 24, 1975 United Kingdom ..... 16957/75

[51] Int. Cl.[2] ..... F01B 3/00; F01B 13/04

[52] U.S. Cl. ..... 91/6.5

[58] Field of Search ..... 91/6.5, 484, 485, 486

[56] References Cited

U.S. PATENT DOCUMENTS

| | | | |
|---|---|---|---|
| 2,288,768 | 7/1942 | Zimmermann | 91/6.5 |
| 2,781,775 | 2/1957 | Merrill | 91/6.5 |
| 2,963,983 | 12/1960 | Wiggermann | 91/6.5 |
| 3,200,761 | 8/1965 | Firth et al. | 91/6.5 |
| 3,905,274 | 9/1975 | Week et al. | 91/6.5 |
| 3,956,969 | 5/1976 | Hein | 91/6.5 |

*Primary Examiner*—John J. Vrablik

*Attorney, Agent, or Firm*—Ladas, Parry, Von Gehr, Goldsmith & Deschamps

[57] ABSTRACT

A rotary hydraulic pump or motor has a piston-carrying rotor having a face engaging a port plate which includes a high pressure port. A number of by-pass passages enable the rotor bores to communicate with the high pressure port before being in full alignment therewith. A valve arrangement is responsive to the pressures in the high pressure port and in successive ones of the rotor bores to provide that variation of these pressures causes variation of the position, relative to top-dead-center, at which successive rotor bores communicate with the high pressure port via the by-pass passages. The arrangement is such that pressures in the rotor bores and the high pressure port, immediately before they communicate, are maintained substantially equal over a range of pressures.

8 Claims, 3 Drawing Figures

ROTARY HYDRAULIC MACHINE HAVING A VALVE RESPONSIVE TO ROTOR BORE PRESSURE AND STATOR PORT PRESSURE

This invention relates to hydraulic machines of the type in which rotation of a piston-carrying rotor accompanies displacement of a liquid through the machine.

It is known, in machines of the foregoing type, to provide a port plate which is provided with an opening and which has a surface engaged by a face of the rotor. The rotor has bores through which displaced liquid flows, and rotation of the rotor causes these bores to be successively brought into communication with the port plate opening.

At the instant of first communication between a bore and the port plate opening a rapid change of pressure, accompanied by a shock wave, can occur within the bore, unless the pressures in the bore and opening are substantially equal. It has in the past been proposed to overcome this problem by providing suitable precompression or decompression of the liquid within the bores, prior to these bores being brought into communication with the port plate opening. Such a solution is effective only when the pressure within the port plate opening remains substantially constant. This pressure is typically a high delivery pressure, in the case of a pump, or a high supply pressure, in the case of a motor, and it is usual for such machines to be required to operate over a wide range of delivery or supply pressures. It may also be required that the displacement of the machine shall be varied by altering the effective strokes of the machine pistons, with consequent variation in the precompression or decompression of liquid in the rotor bores.

It is another object of the invention to provide a rotary hydraulic machine in which differences between the pressures in the rotor bores and the port plate opening are substantially reduced over a substantial range of operating pressures.

According to the invention a rotary hydraulic machine comprises a housing, a rotor within the housing, said rotor having a plurality of bores which open on to a face of the rotor, means, responsive to rotation of the rotor, for causing liquid displacement within said bores to accompany said rotation, a port plate against one face of which said rotor face is engaged, said port plate including a first port with which said bores can successively communicate, a first passage in said port plate, said first passage communicating with said first port and with port means which open on to said port plate face, said port means being spaced from said first port, in a direction of the path of movement of said bores across said face, so that said bores communicate, in use, with said port means before communicating with said opening, said port means extending in said direction of movement, and a control element, responsive to an increase in pressure in said bores, for progressively uncovering said port means in a direction away from said opening.

One example of a machine according to the invention will now be described with reference to the accompanying drawings, in which.

Figure 1:
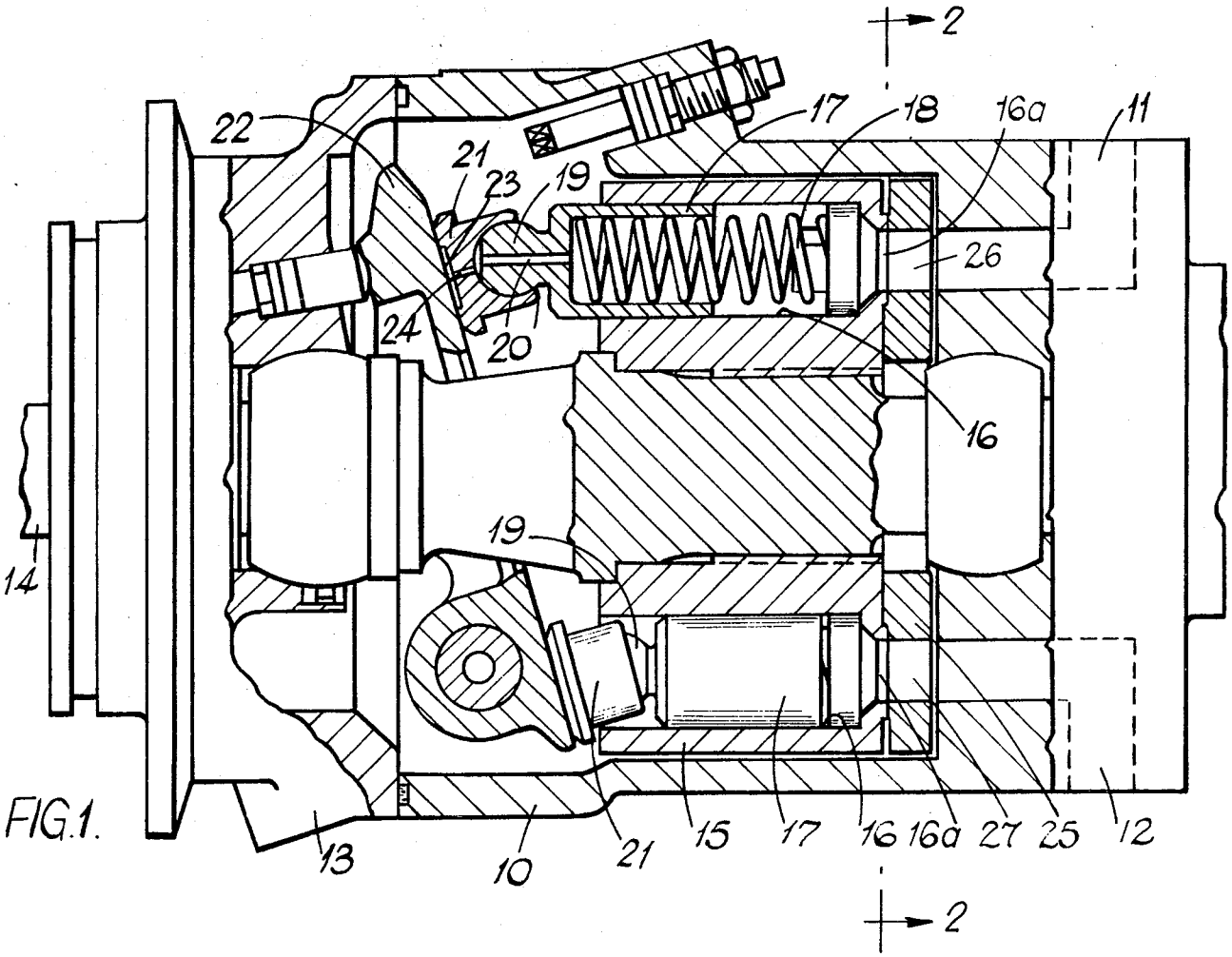
FIG. 1 is a section through an axial-piston pump.

Referring firstly to FIG. 1 the pump is of the swash plate type and comprises a hollow housing 10 having an outlet 11 and an inlet 12 at one end. The other end of the housing is closed by an end cover 13 in which is journalled a shaft 14. Connected to the shaft 14 and disposed inside the housing 10 is a rotor 15 in which are formed a plurality of angularly spaced bores 16 each containing a plunger 17 backed by a conpression spring 18. The bores 16 terminate in portions **16*a* which open on to one end face of the rotor 15**.

Each plunger 17 has a spherical end portion 19 having its end directed away from the opposite end face of the rotor 15 flat ended. A bore 20 in each spherical end portion 19 opens into the interior of the plunger 17 at one end and on to the flat ended face of the end portion 19 at the other end. The end portions 19 are respectively engaged in complimentary sockets in slippers 21. Each slipper has a face which is formed with an hydrostatic bearing pocket 23 which communicates via a bore 24 in the slipper with the space within the slipper defined by the flattening of the associated end portion 19.

The slippers 21 bear against an inclined swash plate 22 disposed adjacent the end cover 13. As the rotor is rotated, in use, the swash plate causes reciprocation of the plungers 19 in their respective bores 16.

Interposed between said one end of the rotor 15 and the end of the housing in which said outlet 11 and inlet 12 are formed is an annular port plate 25. This plate 25 is formed with two arcuate ports 26, 27 through the intermediary of which liquid can pass between the inlet 12 and the outlet 11 and the passages **16*a* in the rotor 15. The port 26 is in communication with the outlet 11, whilst the port 27 is in communication with the inlet 12**.

Figure 2:
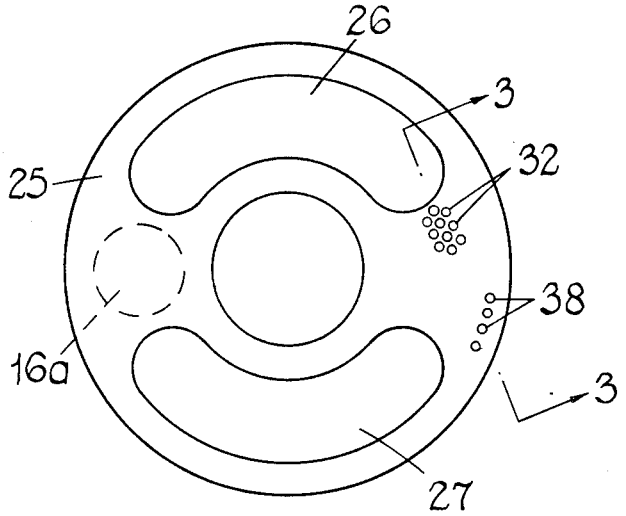
FIG. 2 is a view of a port plate of the pump, as seen on line 2—2 in FIG. 1, and, FIG. 3 is a part-section, to an enlarged scale, on line 3—3 in FIG. 2.

In the example shown the rotor 15 moves, in use, anticlockwise, as seen in FIG. 2, so that the bore portions **16*a*, one of which is indicated in FIG. 2, sweep across the ports 26, 27** sequentially.

A bore 30 extends within the port plate 25 and communicates with one end of the port 26. A plurality of holes 31 communicate with the bore 30 and open on to the face **25*a* of the port plate 25 which is engaged by the rotor 15. Holes 31 and bore 30 define a first passage through which liquid can flow to the port 26. Holes 31 also provide a plurality of ports 32 which are spaced from each other and from the adjacent end of the port 26. The ports 32 extend away from the adjacent end of port 26, in the path of movement of bore portions 16*a*, so that each of the bore portions 16*a* successively communicates with the ports 32 before communicating with the port 26**.

The port plate 25 also includes a cylinder 33 which is axially aligned with the bore 30, and a spool control element 34 has a control piston portion 35, and an actuator piston portion 36 respectively slidable in the bore 30 and cylinder 33. A plurality of passages 38 extend in an arc adjacent the edge of the port plate 25 and are spaced apart in the path of movement of a point on the face of rotor 15 over port plate 25. Passages 38 connect cylinder 33 with the face **25*a* of port plate 25**.

Figure 3:
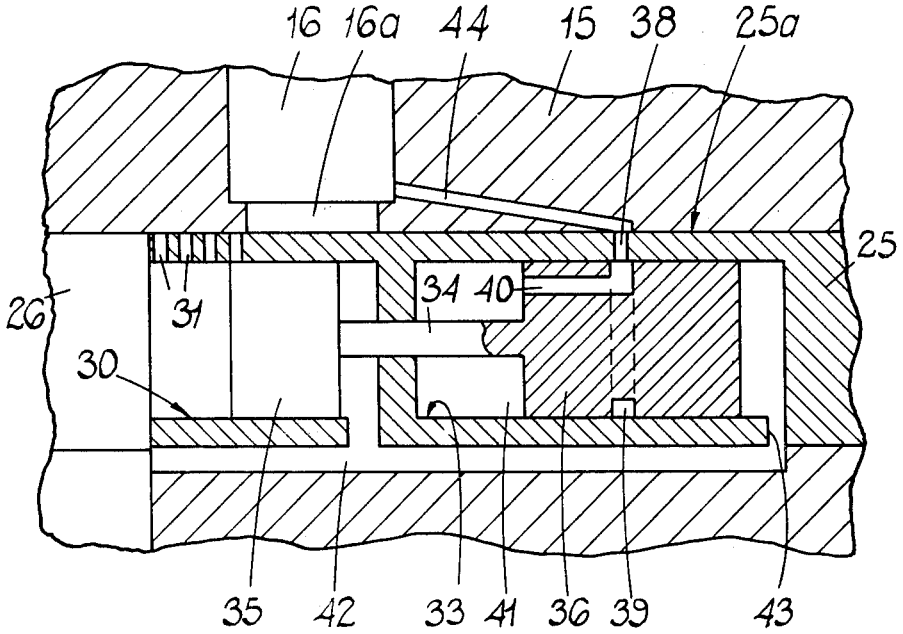

Actuator piston portion 36 has an annular groove 39 which communicates via a passage 40 with a volume 41 which is defined within cylinder 33 by piston portion 36. An increase in pressure within groove 39 urges element 34 to the right, as shown in FIG. 3, so as successively to uncover holes 31. A passage 42 allows the side of piston portion 35 remote from port 26, and the side of piston portion 36 remote from volume 41, to be subjected to the pressure within port 26. This pressure is applied to piston portion 36 via a restricted orifice 43.

Rotor 15 has a plurality of passages 44 connecting respective ones of bores 16 with that face of rotor 15 which engages face 25*a* of port plate 25. The ends of passages 44 remote from the bores 16 are positioned so as to pass sequentially across the passages 38 as the rotor 15 rotates.

In use the pump operates in a known manner to draw fluid from inlet 12 and to discharge it at a higher pressure from outlet 11. As each of the pistons 17 moves onwards from its top dead centre position, fluid within the bores 16 is compressed prior to discharge through the port 26. The precompression pressure within a bore 16 is applied to its associated passage 44.

Spool control element 34 is positioned in accordance with the difference between the pressures in port 26 and volume 41. Assume element 34 is initially in its most leftward position, as seen in FIG. 3. In this position holes 31 are shut off by piston portion 35 and the annular groove 39 in piston portion 36 communicates with the most anticlockwise one of passages 38, i.e. that which is nearest to port 26. If the precompression pressure within a bore 16 is greater than the pressure in port 26, introduction of this precompression pressure to volume 41 urges element 34 to the right to uncover the one of holes 31 which is nearest the port 26. This rightward movement is almost instantaneous, and stops when groove 39 ceases to communicate with the most anticlockwise of passages 38 and communicates with the next adjacent passage 38.

The element 34 is in this way moved to the right in one or more steps until the precompression pressure in the bores 16 is equal to that in port 26. Any subsequent variation of the precompression pressure, or of the pressure in port 26, will cause element 34 to move in steps to a new equilibrium position. It will be understood that these movement steps occur when successive passages 44 communicate, via an appropriate one of passages 38, with the volume 41. The element 34 will thus move rapidly to its equilibrium position.

Since element 34 is thus responsive to the difference between the precompression pressure and the pressure at the pump outlet 26, it will be understood that the dimensions and locations of the ports 32 and passages 38 may readily be arranged so that the precompression pressure is maintained substantially equal to that within port 26, and that this condition can be maintained during variations in the strokes of pistons 17.

It will also be understood that the invention is equally applicable to radial piston pumps, where variation in the piston strokes may be accompanied by variations, relative to the port plate, of the position at which piston top dead centre occurs.

The invention is also applicable to hydraulic motors, the ports 32 and passages 38 being located, as before, adjacent the high pressure ports 26, which in this case communicates with the motor inlet, so that the bores 16 are brought into communication with port 26 when the pressures in port 26 and bores 16 are substantially equal.

I claim:

1. A rotary hydraulic machine comprising a housing, a rotor within the housing, said rotor having a plurality of bores which open onto a face of the rotor, means, responsive to rotation of the rotor, for causing liquid displacement within said bores to accompany said rotation, a port plate against one face of which said rotor face is engaged, said port plate including a first port with which said bores can successively communicate, a first passage in said port plate, said first passage communicating with said first port and with port means which open on to said port plate face, said port means being spaced from said first port, in a direction of the path of movement of said bores across said port plate face, so that said bores communicate, in use, with said port means before communicating with said first port, said port means extending in said direction of movement, and a control element, responsive to an increase in pressure in said bores, for progressively uncovering said port means in a direction away from said first port, and to an increase in pressure in said first port for progressively covering said port means in a direction towards said first port.

2. A machine as claimed in claim 1 in which said port means comprises a plurality of second ports spaced apart in said direction of movement.

3. A machine as claimed in claim 1 in which said control element includes an actuator piston portion having one side responsive to the pressures in said bores and another side responsive to the pressure within said first port.

4. A machine as claimed in claim 3 which includes a restricted orifice by means of which the pressure in said first port is applied to said actuator piston portion.

5. A machine as claimed in claim 3 which includes a second passage in said port plate, by means of which second passage the pressures in said bores may be applied to said one side of the actuator piston.

6. A machine as claimed in claim 5 in which said control element includes a passage which can communicate with the, or a selected, port plate second passage to convey the pressure therein to said one side of the actuator piston portion.

7. A machine as claimed in claim 5 in which said rotor includes a plurality of passages which communicate with respective ones of said bores and which have openings on said rotor face, and which includes a plurality of said second passages in the port plate, said second passages opening on to said one face of the port plate at spaced locations which lie on the path thereover of said rotor passage openings so that said bores communicate with said second passages before communicating with said first port.

8. A machine as claimed in claim 7 in which said control element is also operable to selectively open and close said second passages, movement of said control element in response to an increase in pressure in said rotor bores, or to a decrease in pressure in said first port causing said bore pressures to be applied to said piston portion via selected ones of said second passages which open on to said one face at increasing distances from said first port.

* * * * *